United States Patent [19]

Bussolino

[11] Patent Number: 4,876,784

[45] Date of Patent: Oct. 31, 1989

[54] METHOD FOR ON-SITE MAINTENANCE OF GUARDRAILS

[75] Inventor: Romolo Bussolino, Castiglione d'Asti, Italy

[73] Assignee: Hastasider Metal S.R.L., Asti, Italy

[21] Appl. No.: 222,264

[22] Filed: Jul. 21, 1988

[30] Foreign Application Priority Data

Jul. 24, 1987 [IT] Italy ..... 67655 A/87
Mar. 18, 1988 [IT] Italy ..... 52985/88[U]

[51] Int. Cl.[4] ..... B23P 6/00; E01B 27/06; B61B 13/04

[52] U.S. Cl. ..... 29/402.06; 29/402.07; 29/402.08; 29/402.18; 29/426.2; 238/162; 238/310; 105/141

[58] Field of Search ..... 29/402.06, 402.08, 402.18, 29/426.2, 402.07; 15/54; 51/178; 104/118, 119, 120; 105/141, 142, 143, 144; 238/162, 163, 164, 310, 311, 312; 118/47

[56] References Cited

U.S. PATENT DOCUMENTS

| | | | |
|---|---|---|---|
| 3,140,885 | 7/1964 | Bastis et al. . | |
| 3,308,266 | 3/1967 | Adams Jr. | 238/164 X |
| 3,532,070 | 10/1970 | Lamarque . | |
| 4,632,038 | 12/1986 | Lawrence | 105/141 X |
| 4,635,839 | 1/1987 | Slavens | 105/144 X |

FOREIGN PATENT DOCUMENTS

| | | | |
|---|---|---|---|
| 172062 | 5/1987 | European Pat. Off. . | |
| 2731208 | 4/1979 | Fed. Rep. of Germany . | |
| 65072 | 7/1972 | Luxembourg . | |
| 638579 | 9/1983 | Switzerland | 29/402.06 |

OTHER PUBLICATIONS

Hergebruik van Geleiderail, 830A PT/Civiele Techniek, No. 11, 1983, pp. 5–8, Rijswijk, Netherland.

*Primary Examiner*—Timothy V. Eley
*Assistant Examiner*—Peter D. B. Vo
*Attorney, Agent, or Firm*—Pearne, Gordon, McCoy & Granger

[57] ABSTRACT

A method for on-site maintenance of a guardrail consisting of a continuous strip of metal section segments supported on posts at joints between adjacent segments, the guardrail is split at one of joints and the segments of one of the resulting two portions of the guardrail are detached successively from the posts and fed, still connected to adjacent segments, into an apparatus traveling along the strip and inside which the segments are subjected continuously to cleaning, metal facing and protective processes. Once processed, the segments come out successively from one end of the apparatus, as the latter travels along the guardrail, and are reconnected successively to the posts.

9 Claims, 2 Drawing Sheets

METHOD FOR ON-SITE MAINTENANCE OF GUARDRAILS

BACKGROUND OF THE INVENTION

The present invention relates to a method for on-site maintenance of guardrails.

In particular, the present invention relates to a method for the routine maintenance of metal guardrails, i.e. consisting of a series of metal section segments, usually formed from zinc-plated corrugated iron section. The said segments are usually bolted together into a continuous strip supported, at a given height off the ground, by posts usually located at the said joints and in turn connected by one or more bolts to the said continuous strip. The routine maintenance of a guardrail of the aforementioned type usually consists in detaching the metal section segments from the supporting posts and adjacent segments, and transferring them to a maintenance plant for cleaning and zinc-plating. The processed segments are then taken back and reassembled using new bolts, the original ones invariably being damaged when dismantling the segments.

Alternatively, the said segments are replaced by new ones, and stored for future use after processing.

The above method presents a number of major drawbacks, both economically and technically.

The major expense item involved is the labour required for dismantling and reassembling the guardrail. Whereas detaching adjacent segments off the supporting post usually requires the removal of one bolt, the separation of two adjacent segments usually involves removing eight, all of which are invariably replaced when reassembling the segments. Furthermore, once detached and separated, the segments must be transferred to a maintenance plant, and back to the assembly site after processing.

A major technical drawback of the above system is the relatively time-consuming job of dismantling and reassembling the guardrail, which inevitably results in prolonged inconvenience to traffic.

SUMMARY OF THE INVENTION

The aim of the present invention is to provide a method for the routine maintenance of guardrails, requiring relatively little labour and the replacement of only a limited number of parts, and which provides for substantially eliminating transport costs, and drastically reducing downtime.

With this aim in view, according to the present invention, there is provided a method for on-site maintenance of guardrails consisting of a number of posts; a number of metal section segments; a number of first joints connecting the said segments into a continuous strip; and a number of second joints connecting the said continuous strip to the said posts; said method comprising the steps of: starting at a first portion of said guardrail, successively dismantling the said second joints on the said first portion;

moving along the said first portion a mobile, continuous maintenance apparatus by which unprocessed segments on the said first portion are engaged as they are detached from the respective said posts by dismantling the respective said second joints; the said apparatus presenting a processing tunnel with an input for the unprocessed segments and an output for processed segments processed in said apparatus;

reconnecting said processed segments to said posts by reforming the respective said second joints as said processed segments come out of said output, thus defining a bend moving with said apparatus along the guardrail, and consisting of a number of adjacent segments supported on said apparatus and connected by respective said first joints into a continuous strip.

According to the present invention, there is also provided an apparatus for on-site maintenance of guardrails consisting of a number of posts; a number of metal section segments; a number of first joints connecting the said segments into a continuous strip; and a number of second joints connecting the said continuous strip to the said posts; said apparatus being characterised by the fact that it comprises a truck; a processing tunnel on the said truck, for continuously and successively processing the said segments, and presenting an input and an output for the said segments; and drive means for moving the said truck parallel with a line joining the said input to the said output.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 4:
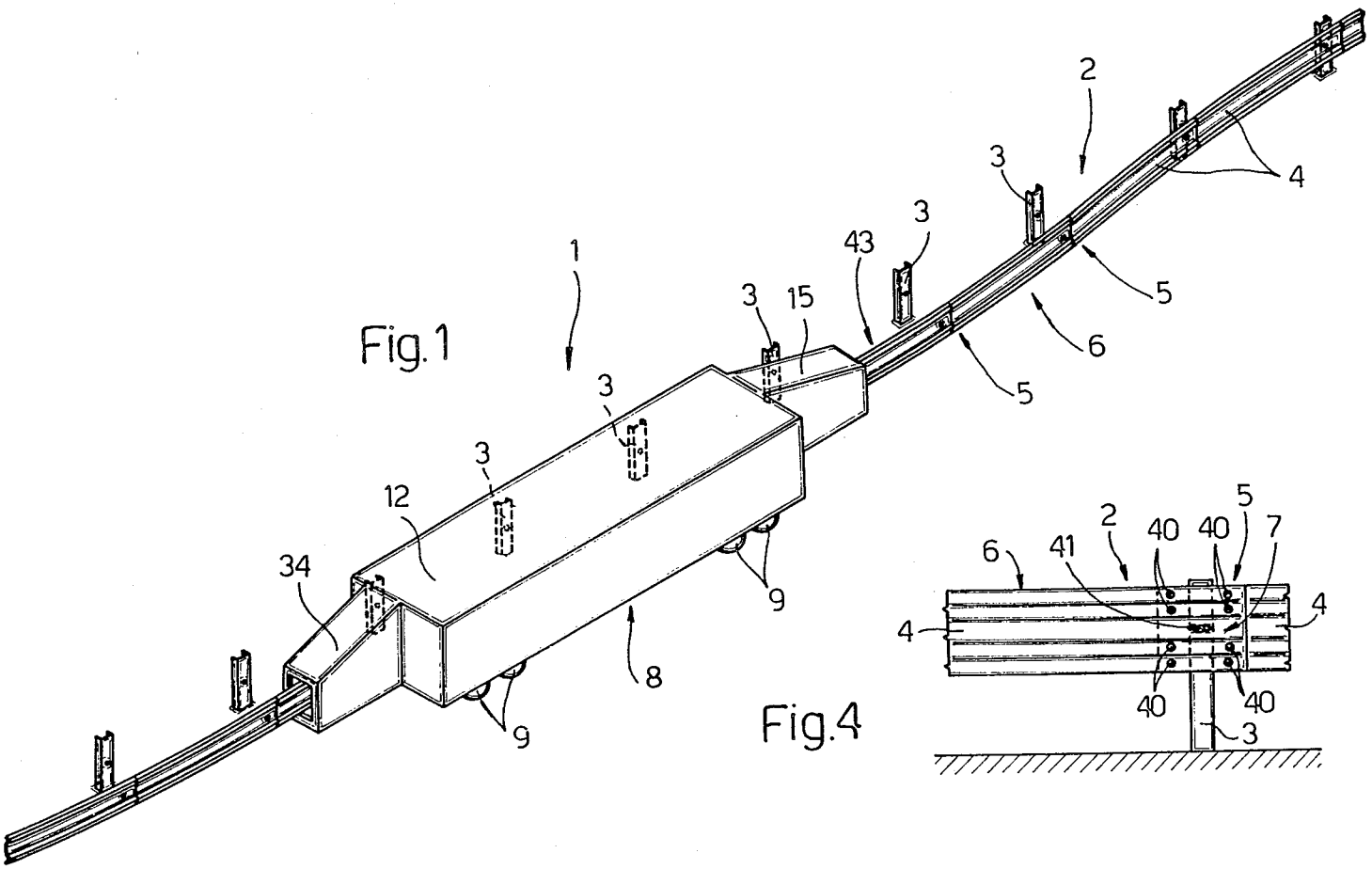
FIG. 1 shows a schematic view in perspective of a preferred embodiment of a guardrail maintenance apparatus in accordance with the teachings of the present invention.
FIG. 4 shows a side view of a guardrail portion.
Figure 2:
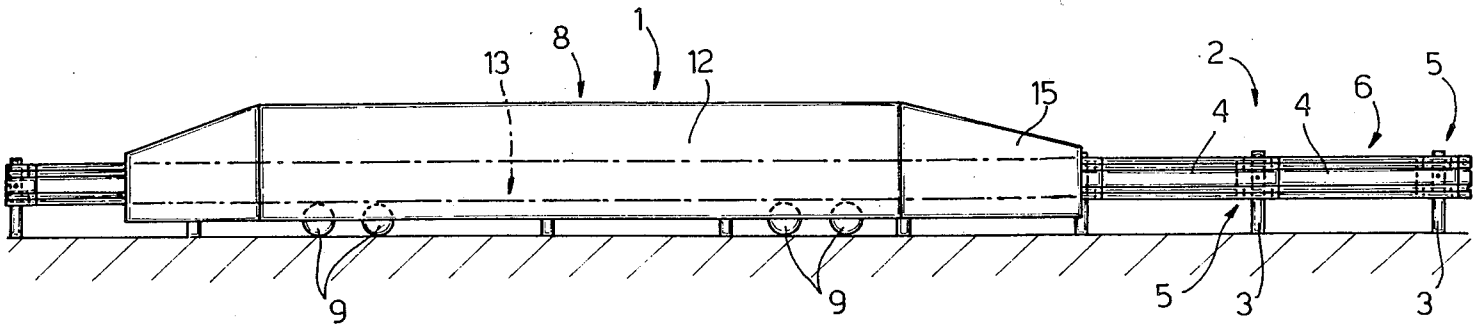
FIG. 2 shows a side view of the FIG. 1 apparatus.
Figure 3:
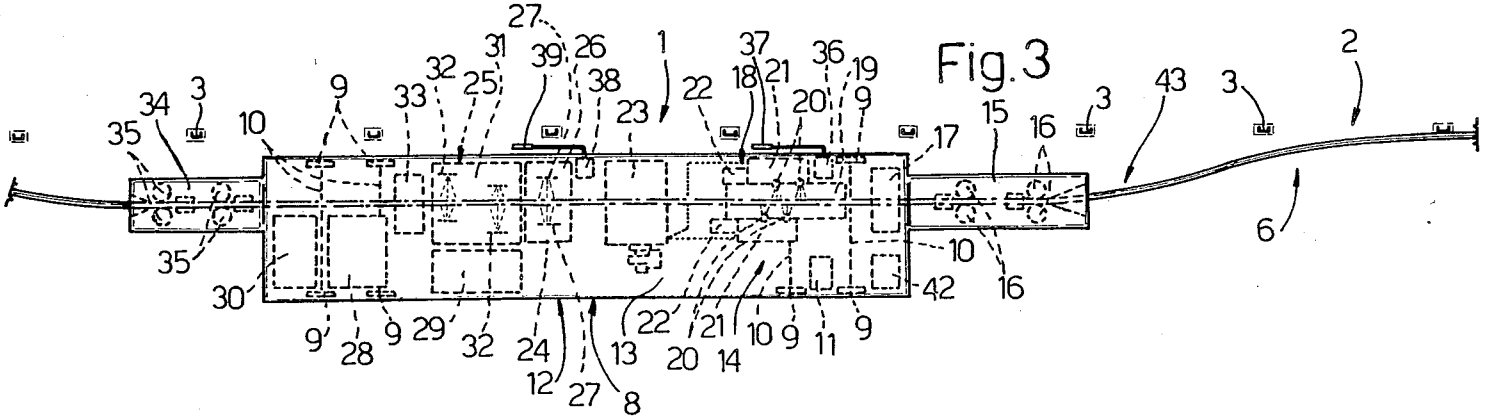
FIG. 3 shows a plan view of the FIG. 1 apparatus.

Number 1 in FIGS. 1, 2 and 3 indicates a mobile apparatus for the maintenance of a guardrail indicated as a whole by 2.

As shown, particularly in FIG. 4, guardrail 2 consists of a number of posts 3; a number of in-line segments 4 formed of zinc-plated corrugated metal section; a number of first joints 5 connecting the ends of adjacent segments 4 into a continuous strip 6; and a number of second joints 7 connecting strip 6 to posts 3.

As shown in FIGS. 1 and 2, and particularly FIG. 3, mobile apparatus 1 comprises a self-propelled truck 8 traveling on wheels 9, the shafts 10 of which are at least partially powered by a motor 11 housed inside body 12 and supported on frame 13, and to which shafts 10 are connected in known manner (not shown).

Body 12 defines a processing tunnel 14 comprising an input duct 15 for strip 6, which duct 15 presents a number of pairs of opposed rollers 16 for guiding strip 6 to a drying chamber 17 through which the said strip 6 is dried prior to further processing.

Tunnel 14 also comprises a closed-cycle sandblasting unit 18 in turn comprising a sandblasting chamber 19 immediately downstream from chamber 17 and inside which strip 6 is blasted by jets 20 with sand supplied in known manner by turbines 21 from bins 22 on frame 13. Conveyors (not shown) at the bottom of chamber 19 feed the used sand in known manner to a filtering apparatus 23 and, from there, back into bins 22.

Tunnel 14 also comprises a first and second flame spraying unit, 24 and 25, respectively, arranged in line and immediately downstream from sandblasting unit 18.

Unit 24 comprises a flame spraying chamber 26 wherein known metal spray guns 27, supplied by a compressor 28 and generators 29 connected to generating set 30, continuously spray strip 6 with molten metal, usually steel, for increasing the thickness of segments 4 as required. Unit 25 comprises a flame spraying chamber 31 wherein known metal spray guns 32, also supplied by compressor 28 and generators 29 connected to generating set 30, continuously spray strip 6 with a protective metal coating. As shown in FIG. 3, tunnel 14 preferably also comprises a known painting unit 33 connected to compressor 28 and located between flame spraying unit 25 and an output duct 34 for strip 6, said duct 34 presenting a number of pairs of opposed rollers 35 for guiding the said strip 6.

As shown in FIG. 3, truck 8 also supports an external sandblasting unit 36 having an external manually-operated nozzle 37 for blasting throwaway sand supplied by turbines 21; and an external flame spraying unit 38 having an external manually-operated metal spray gun 39 connected to compressor 28 and generators 29.

In actual use, truck 8 is set up on the road, adjacent to the portion of guardrail 2 for processing, so that tunnel 14 extending axially between input and output ducts 15 and 34 is substantially parallel with guardrail 2.

Ground operators then dismantle first joint 5 on the near end of the guardrail 2 portion for processing, by removing or, more often, breaking off the eight bolts 40 (FIG. 4) of which joint 5 is composed, and then removing a further bolt 41 constituting respective second joint 7. The same operators then dismantle successive joints 7, so as to detach a first portion 44 of strip 6 from posts 3, and feed the free end first portion of strip 6 inside input duct 15 of apparatus 1. At this point, the operator in cab 42 on truck 8 starts up motor 11 so as to move truck 8 along the guardrail 2 portion for processing, at the same time feeding strip 6, detached from posts 3, along tunnel 14.

As they travel along tunnel 14, segments 4 of strip 6 are successively and continuously dried inside chamber 17; sandblasted inside chamber 19; flame sprayed, if necessary, inside chamber 26 for increasing the thickness of the segments; flame sprayed with a protective metal coating inside chamber 31; and, if necessary, fully coated inside unit 33, wherein each segment 4 is coated with filler for sealing any pores left on the surface of the segments by the protective metal spray process.

Once processed, segments 4, still connected by joints 5 into a continuous strip 6, come out through output duct 34, and are reconnected by further ground operators at second joints to posts 3. As the ground operators detach and replace joints 7 up and downstream, respectively, from truck 8, maintenance is continued by truck 8 moving along guardrail 2, so that apparatus 1 operates along a mobile bend 43 in strip 6 supported on truck 8, with no need for dismantling joints 5.

At the end of the guardrail 2 portion being processed, the far end joint 5 on bend 43 is dismantled for detaching truck 8 from guardrail 2.

As truck 8 travels along strip 6, ground operators provide for manual sandblasting and protective metal spray coating of posts 3 using nozzle 37 and gun 39 respectively.

The advantages of apparatus 1 according to the present invention will be clear from the foregoing description. Firstly, only joints 7 (one bolt 41) and no longer joints 5 (eight bolts 40) are dismantled along strip 6. Secondly, segments 4 are no longer separated and transferred, but remain connected along strip 6, and only bolts 41 are replaced. A major advantage, however, in addition to those mentioned above, is that apparatus 1 provides, if necessary, for continuously increasing the thickness of segments 4 via unit 24, thus eliminating the cause of existing guardrails being rejected, and which has so far remained unsolved by existing routine maintenance methods.

What is claimed is:

1. A method for on-site maintenance of guardrails consisting of a number of posts; a number of metal section segments; a number of first joints connecting the said segments into a continuous strip; and a number of second joints connecting the said continuous strip to the said posts; said method comprising the steps of:

starting at a first portion of said guardrail;

successively dismantling the said second joints on the said first portion;

moving along the said first portion a mobile, continuous maintenance apparatus by which unprocessed segments on the said first portion are engaged as they are detached from the respective said posts by dismantling the respective said second joints, the said apparatus presenting a processing tunnel with an input for the unprocessed segments and an output for processed segments processed in said apparatus;

reconnecting said processed segments to said posts by reforming said second joints as said processed segments come out of said output, thus defining a bend moving with said apparatus along the guardrail, and consisting of a number of adjacent segments supported on said apparatus and connected by respective said first joints into a continuous strip.

2. The method as claimed in claim 1, including a step wherein said segments are metal coated.

3. The method as claimed in claim 2, including the step of giving said segments a protective metal coating.

4. The method as claimed in claim 2, characterised by the fact that the said metal coating step consists in increasing the thickness of the said segments by coating the same with molten metal.

5. The method as claimed in claim 4, characterised by the fact that said metal coating is applied by flame spraying.

6. The method as claimed in claim 1, including a further painting step of said segments.

7. The method as claimed in claim 6, characterised by the fact that the said painting step is performed using filler.

8. The method as claimed in claim 1, including an initial drying step.

9. The method as claimed in claim 1, including a sandblasting step.

* * * * *